US009600963B2

(12) United States Patent
Kilby

(10) Patent No.: US 9,600,963 B2
(45) Date of Patent: Mar. 21, 2017

(54) GAMING MACHINE, GAMING SYSTEM, AND GAMING METHOD PRESENTING GAMES WITH ARTIFICIALLY INTELLIGENT PLAYERS

(71) Applicant: Jimmie Ray Kilby, Escondido, CA (US)

(72) Inventor: Jimmie Ray Kilby, Escondido, CA (US)

( * ) Notice: Subject to any disclaimer, the term of this patent is extended or adjusted under 35 U.S.C. 154(b) by 0 days.

(21) Appl. No.: 15/055,378

(22) Filed: Feb. 26, 2016

(65) Prior Publication Data

US 2016/0358415 A1 Dec. 8, 2016

Related U.S. Application Data

(60) Provisional application No. 62/171,623, filed on Jun. 5, 2015, provisional application No. 62/175,380, filed on Jun. 14, 2015, provisional application No. 62/289,190, filed on Jan. 30, 2016.

(51) Int. Cl.
*G07F 17/32* (2006.01)

(52) U.S. Cl.
CPC ..... *G07F 17/3227* (2013.01); *G07F 17/3211* (2013.01); *G07F 17/3244* (2013.01)

(58) Field of Classification Search
CPC ... G07F 17/32; G07F 17/3286; G07F 17/3288
USPC ..... 463/16–20, 9–14, 25
See application file for complete search history.

(56) References Cited

U.S. PATENT DOCUMENTS 5,678,001 A * 10/1997 Nagel ..... A63F 3/022 273/237
7,798,901 B2 9/2010 Nguyen et al.
8,079,903 B2 12/2011 Nicely et al.
8,123,618 B2 2/2012 Karmarkar
8,195,448 B2 * 6/2012 Dargan ..... G06F 3/0237 704/10
8,272,945 B2 9/2012 Kelly et al.
8,360,835 B2 1/2013 Strause et al.
8,447,419 B1 * 5/2013 de Anda Fast ..... G06N 3/126 700/83
8,485,893 B2 7/2013 Rowe
8,540,574 B1 * 9/2013 Kopra ..... G06Q 50/34 463/42

(Continued)

OTHER PUBLICATIONS

Brian Sheppard, World-championship-caliber Scrabble, Artificial Intelligence, vol. 134, Issues 1-2, Jan. 2002, pp. 241-275.*

*Primary Examiner* — Michael Cuff
(74) *Attorney, Agent, or Firm* — Weide & Miller, Ltd.

(57) ABSTRACT

A gaming machine, system, and method for conducting a wagering game utilizing artificially intelligent players. A game is initiated by accepting a wager from a bettor at a gaming machine, displaying a plurality of artificially intelligent player profiles as potential players of a game at the gaming machine, and designating a matchup of at least two of the players for playing the game at the gaming machine. The bettor designates a selected player from the at least two players playing the game. The game is presented at the gaming machine. The RNG is utilized just for randomizing game pieces for playing the game. The artificially intelligent players determine the game play decisions. The game outcome between the artificially intelligent players is determined and wagers are paid out or collected according to the game outcome.

18 Claims, 10 Drawing Sheets

(56) References Cited

U.S. PATENT DOCUMENTS 9,005,008 B2 4/2015 Arnone et al.
2002/0177483 A1* 11/2002 Cannon ..... G07F 17/32 463/42
2003/0195029 A1* 10/2003 Frohm ..... G07F 17/32 463/16
2003/0230848 A1 12/2003 Mellerowicz
2004/0204216 A1* 10/2004 Schugar ..... G07F 17/32 463/16
2005/0288081 A1* 12/2005 Amaitis ..... G07F 17/32 463/6
2006/0049580 A1* 3/2006 Chung ..... A63F 1/00 273/149 R
2007/0087804 A1* 4/2007 Knowles ..... G07F 17/32 463/16
2007/0167219 A1 7/2007 Groz
2007/0225067 A1 9/2007 Olson
2008/0045343 A1* 2/2008 Sauberman ..... G07F 17/32 463/42
2008/0214286 A1* 9/2008 Lutnick ..... G07F 17/3239 463/25
2009/0149233 A1* 6/2009 Strause ..... G06Q 50/34 463/7
2010/0056237 A1* 3/2010 Fraser ..... G06Q 50/34 463/6
2010/0121808 A1 5/2010 Kuhn
2010/0203940 A1* 8/2010 Alderucci ..... G07F 17/32 463/16
2011/0084446 A1* 4/2011 Chan ..... A63F 3/0423 273/272
2013/0083036 A1* 4/2013 Cario ..... G06T 13/00 345/473
2013/0190096 A1* 7/2013 Ronen ..... H04L 29/06034 463/43
2014/0094256 A1 4/2014 Hilbert et al.
2014/0179416 A1 6/2014 Arnone et al.
2015/0065227 A1* 3/2015 Naylor ..... G07F 17/3244 463/25
2015/0141105 A1* 5/2015 Quisquis ..... A63F 1/00 463/11
2015/0231492 A1* 8/2015 Shah ..... A63F 13/22 463/31

* cited by examiner

IF PLAYER 1 WINS

| With | Pays |
|---|---|
| Striaght Flush | $ |
| 4-Kind | $ |
| Full-House | $ |
| Flush | $ |
| Straight | $ |
| 3-Kind | $ |
| Two Pair | $ |
| One Pair | $ |
| High Card | $ |

504a

IF PLAYER 2 WINS

| With | Pays |
|---|---|
| Striaght Flush | $ |
| 4-Kind | $ |
| Full-House | $ |
| Flush | $ |
| Straight | $ |
| 3-Kind | $ |
| Two Pair | $ |
| One Pair | $ |
| High Card | $ |

504b

| | | | | | |
|---|---|---|---|---|---|
| | TL | | F | | TL |
| DL | | | A | | |
| | H | O | R | N | |
| DL | | | M | | |
| | TL | | | | TL |
| | | DL | | DL | |

1240

FIG. 13A

| | | | | | |
|---|---|---|---|---|---|
| | TL | | F | | TL |
| DL | | | A | | |
| | H | O | R | N | |
| DL | | | M | | |
| | P | A | S | T | E |
| | | DL | | DL | |

1240

FIG. 13B

| | | | | | |
|---|---|---|---|---|---|
| | TL | | F | | TL |
| DL | | | A | | |
| | H | O | R | N | |
| DL | | | M | O | B |
| | P | A | S | T | E |
| | | DL | | DL | |

1240

FIG. 13C

GAMING MACHINE, GAMING SYSTEM, AND GAMING METHOD PRESENTING GAMES WITH ARTIFICIALLY INTELLIGENT PLAYERS

CROSS-REFERENCE TO RELATED APPLICATIONS

This application claims priority to U.S. Provisional Application No. 62/171,623 which was filed on Jun. 5, 2015, U.S. Provisional Application No. 62/175,380 which was filed on Jun. 14, 2015, and U.S. Provisional Application No. 62/289,190 which was filed on Jan. 30, 2016, the contents of which are incorporated by reference.

BACKGROUND

The disclosed embodiments relate to methods of presenting and playing games and gaming machines configured to present games.

Many different wagering games have been developed. Wagering games are developed to be monetized by a gaming establishment. Accordingly, such games are configured to provide gamblers with odds of winning such that the gaming establishment will make a profit over time. For example, in a game that has a 1 in 38 chance of a winning, such as Roulette, the game odds for paying a winning wager may be 35 to 1, or something else less than the true odds. In this manner, the gaming establishment over a period of time is likely to recoup the remaining amount.

Early gaming machines incorporated spinning drums, wheels, or reels that randomly stopped on the winning combinations mechanically. In the age of computers and micro-processors, this random selection process is accomplished with random number generators. To this day, all commercially viable gaming machine possibilities are calculable and finite.

Gaming establishments only offer games where the odds may be directly calculated so that the rate of return for the offered games are known. Even where elements of skill may be involved in the games, the games still have a set number of outcomes, and payouts are set to be lower than the true odds. However, there are many games that are more reliant on the skill of the players, and where the odds of winning are not capable of being directly calculated. Accordingly, it is desirable that methods and system be developed for gaming establishments to be able to monetize and offer such games.

SUMMARY

Embodiments of the invention comprise a gaming machine, system, and method for conducting a wagering game utilizing artificially intelligent players. A game is initiated by accepting a wager from a bettor at a gaming machine, displaying a plurality of artificially intelligent player profiles as potential players of a game at the gaming machine, and designating a matchup of at least two of the players for playing the game at the gaming machine. The bettor designates a selected player from the players selected to play the game. The game is presented at the gaming machine. The RNG is utilized just for randomizing game pieces for playing the game. The artificially intelligent players determine the game play decisions. The game outcome between the artificially intelligent players is determined and wagers are paid out or collected according to the game outcome.

In some embodiments, matchup of artificially intelligent players is selected by input from the bettor of the gaming machine. The artificially intelligent players may be configured to have different skill levels which affect the probable outcomes of the game. The wagers may be paid according to a pay table. The odds designated in the pay table may be calculated based on simulations of games played by the artificially intelligent players. In this manner, games where the odds cannot be calculated directly can still be monetized by a gaming establishment.

In further embodiments, the game presented may be a poker game, and the game pieces are at least one deck of playing cards. Other variations on a poker game played by artificially intelligent players may be possible. For example, the bettor may place a bonus bet on the winning hand having a predetermined rank or higher. As another example, the bettor may designate the selected player after at least one card in each player hand is dealt and revealed.

In further embodiments, the game may be a scrabble type game, and the game pieces are letter tiles. In this variation, the bettor may place a bonus bet on which of the artificially intelligent players will have the highest single word total or on a point margin between the artificially intelligent players. In another embodiment, the bettor may place a bonus bet on a number of letters of a longest word played during the game.

Further objects, features, and advantages of the present invention over the prior art will become apparent from the detailed description of the drawings which follows, when considered with the attached figures.

BRIEF DESCRIPTION OF THE DRAWINGS

FIG. 13A, FIG. 13B, and FIG. 13C show game play on a display of a gaming device, according to one exemplary embodiment.

DETAILED DESCRIPTION OF THE EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of playing and presenting games. In a preferred embodiment, the methods of game play and presentation are implemented via a gaming machine or device. Such a gaming machine may have various configurations.

The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
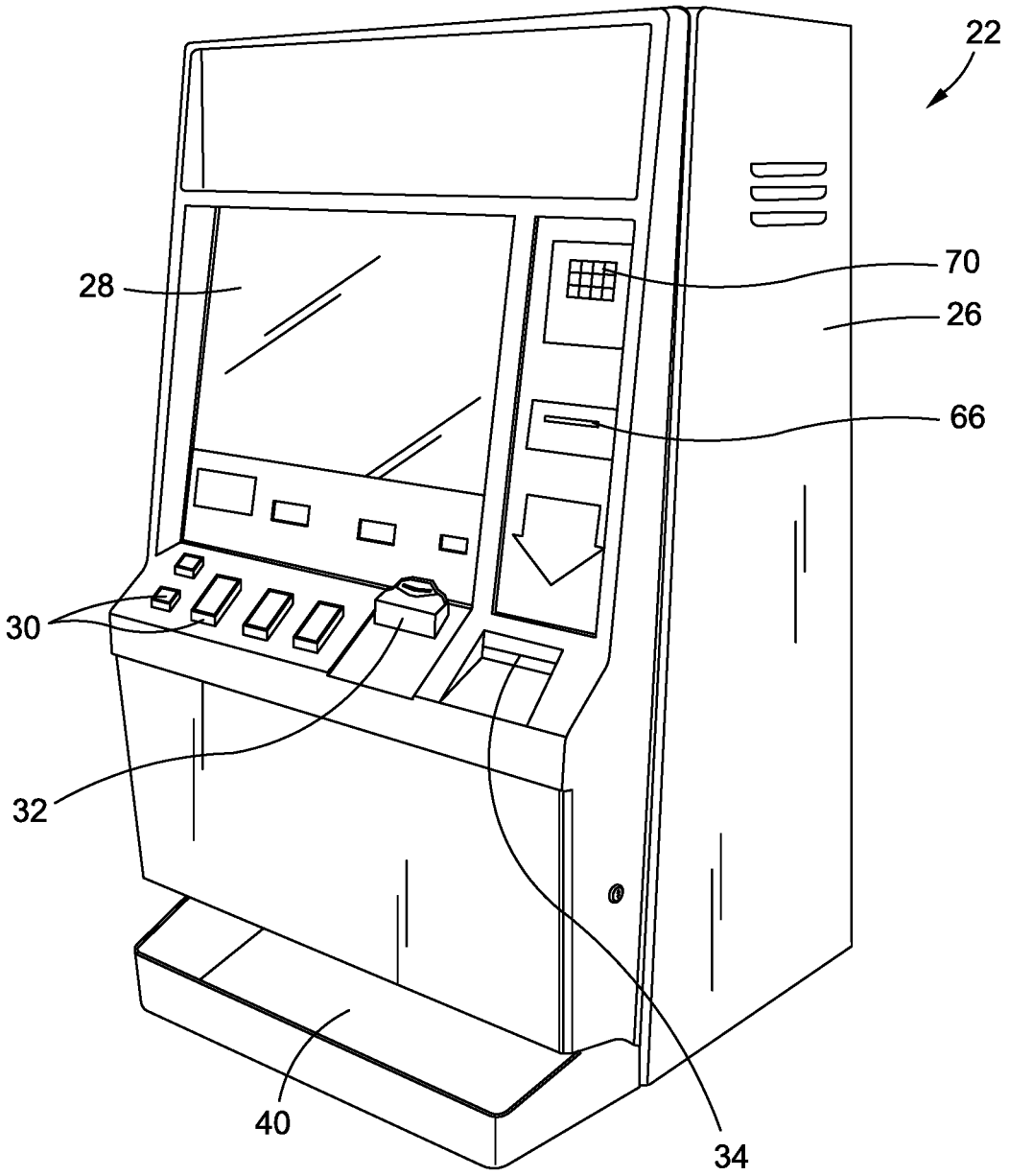
FIG. 1 illustrates a gaming machine according to one exemplary embodiment.
Figure 2:
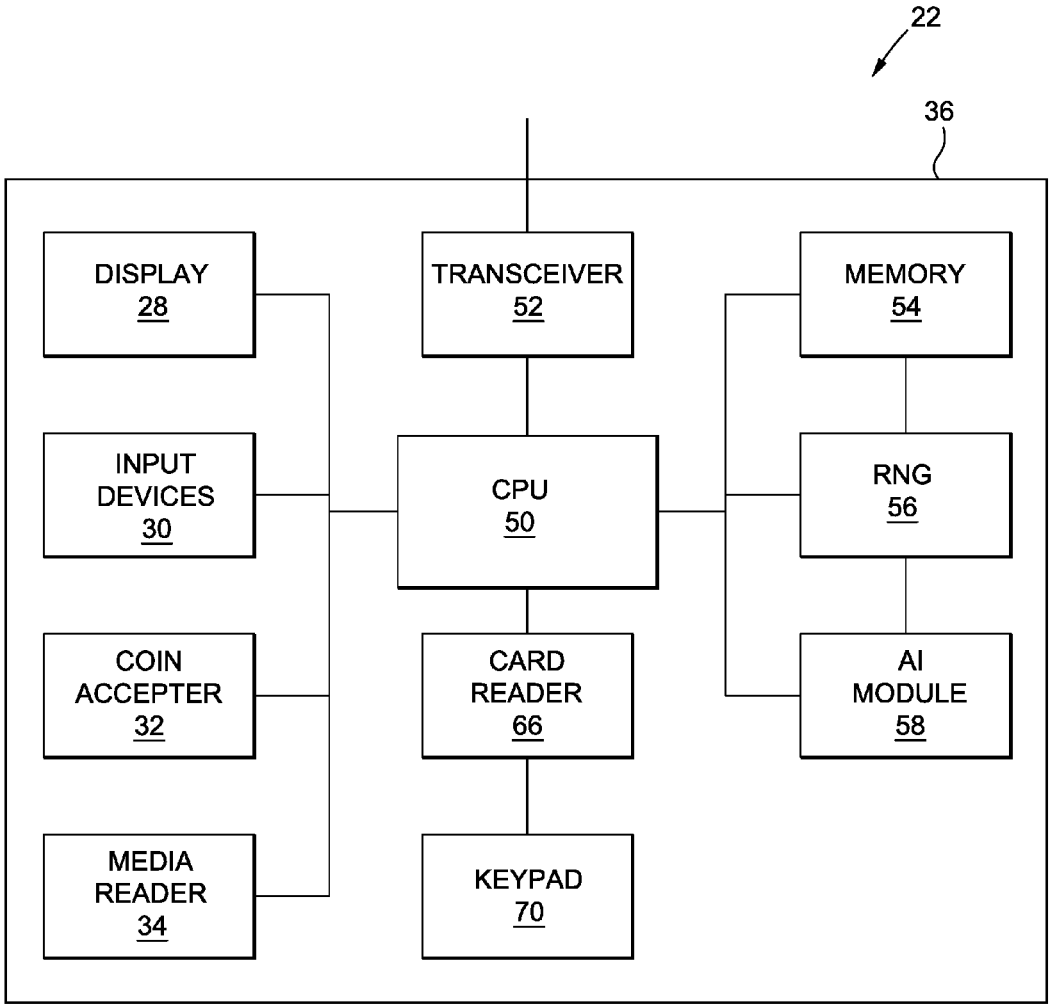
FIG. 2 illustrates a schematic of a gaming machine according to one exemplary embodiment.

One configuration of a gaming machine 22 is illustrated in FIGS. 1 and 2. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26. The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes.

As described in more detail below, the gaming machine 22 is preferably configured to present one or more games upon a player making a monetary payment or wager. In this regard, as described in more detail below, the gaming machine 22 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate cards to be held or discarded, to "cash out" of the gaming machine, or to provide various other inputs.

In one preferred embodiment, the gaming machine 22 includes at least one microprocessor or controller 50 for controlling the gaming machine, including receiving player input and sending output signals for controlling the various components of the machine 22 (such as generating game information for display by the display 28). The controller 50 may be arranged to receive information regarding funds provided by a player to the gaming machine, receive input such as a purchase/bet signal when a purchase/bet button is depressed, and receive other inputs from a player. The controller 50 may be arranged to generate information regarding a game, such as generating game information for display by the at least one display 28 (such as information comprising an artificially intelligent casino game, as detailed below), for determining winning or losing game outcomes and for displaying information regarding awards for winning game outcomes, among other things.

The controller 50 may be configured to execute machine readable code or "software" or otherwise process information, such as obtained from a remote server via a transceiver 52. Software or other instructions may be stored on a memory or data storage device 54. The memory 54 may also store other information, such as pay table information. The gaming machine 22 may also include one or more random number generators 56 for generating random numbers, such as for use in selecting cards, game symbols, or other virtual game pieces. This allows the game to be presented in a random fashion or in a pseudo-random fashion. That is, the game may be presented in a manner in which the player cannot control the outcome or in which there is a skill element to the game, but the player still cannot entirely control the outcome.

Preferably, the controller 50 is configured to execute machine readable code or instructions which are configured to implement the method of game play of the disclosed embodiments. For example, the controller 50 of the gaming machine 22 may be configured to detect a wager, such as a signal from a player's depressing of the "bet one" button. Upon such an event and/or the player otherwise signaling the gaming machine to present the game, the controller 50 may be configured to cause game symbols or other game information to be displayed on the at least one display 28. The controller 50 may accept input from a player of game inputs, such as a request to spin reels or the like, via the one or more player input devices 30 of the gaming machine 22.

In some embodiments, the gaming machine 22 may also include an artificial intelligence module 58. The artificial intelligence module 58 may include one or more memories and processors to store and execute artificial intelligence for one or more artificially intelligent casino game players. The artificial intelligence module 58 may receive game information from the controller 50, such as cards dealt to an artificially intelligent character. Based on the game information received, the artificial intelligence module 58 is configured to perceive and recognize a game situation, and to learn and apply game rules to provide input back to the controller 50 for game play decisions by the artificially intelligent character.

The gaming machine 22 may be configured to generate and present games in a stand-alone manner or it may be in communication with one or more external devices via the transceiver 52 at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22. The gaming machine may also be configured to conduct electronic funds transfers based on any other input provided by a player.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 22 may also include a player tracking device, such as a card reader 66 and associated keypad 70. Such player tracking devices are well known and may permit the game operator to track play of players of the gaming machine. The tracked play may be utilized to offer player bonuses or awards.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIG. 1 is only exemplary of one embodiment of a gaming machine. For example, it is possible to for the gaming machine to have various other configurations, including different shapes and styles and having different components than as just described.

For example, instead of comprising a "casino"-style gaming machine, it is possible for the game of the invention to be presented on a computing device (a game presentation device), including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, a social network, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays.

Figure 3:
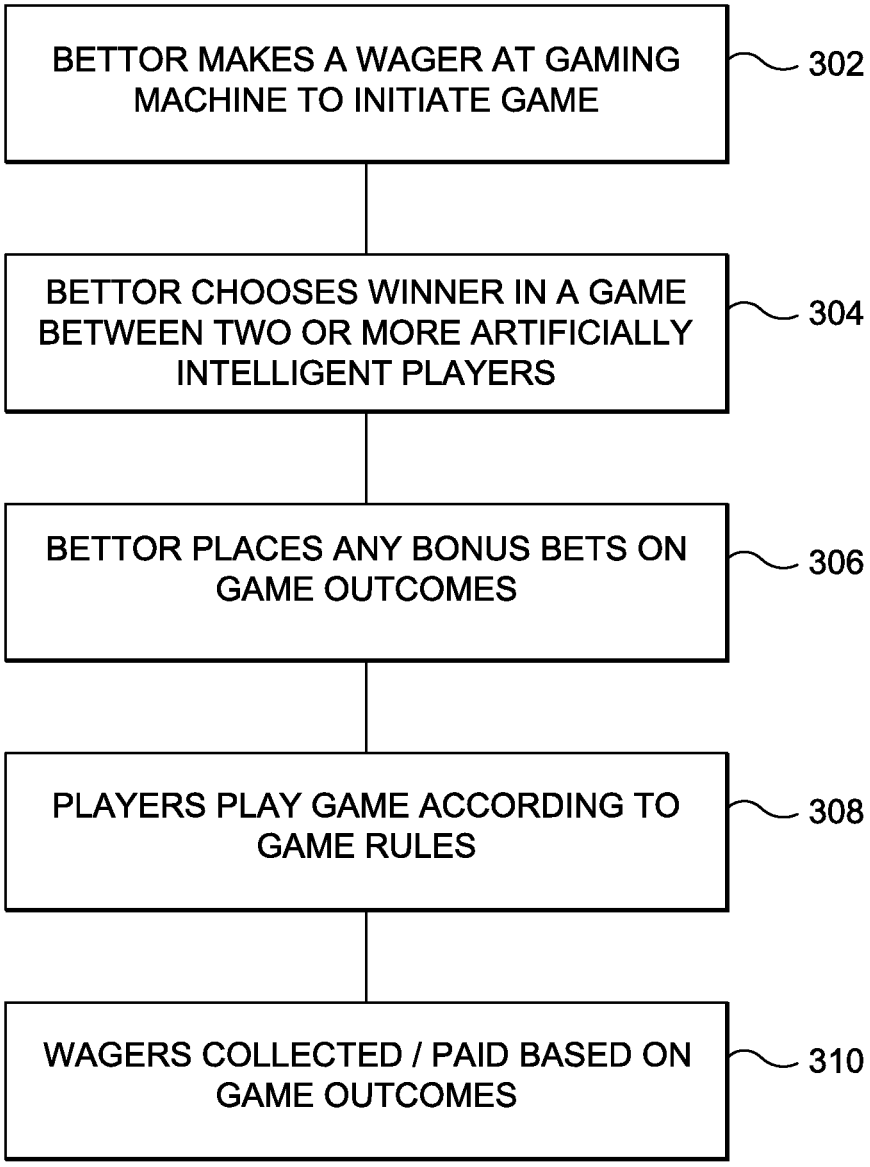
FIG. 3 shows a flow chart for conducting a game with artificially intelligent players, according to one exemplary embodiment.

One embodiment of a method of playing and presenting a game in accordance with an embodiment of the invention will be described with reference to FIG. 3. In FIG. 3, a bettor makes a wager at a gaming machine to initiate a game in step 302. Here, the game is a casino wagering game played between two or more artificially intelligent players. In the following example, a video poker type casino game of Seven Card Hold'em is used. However, the principles can be applied to any number of games.

Figure 4:
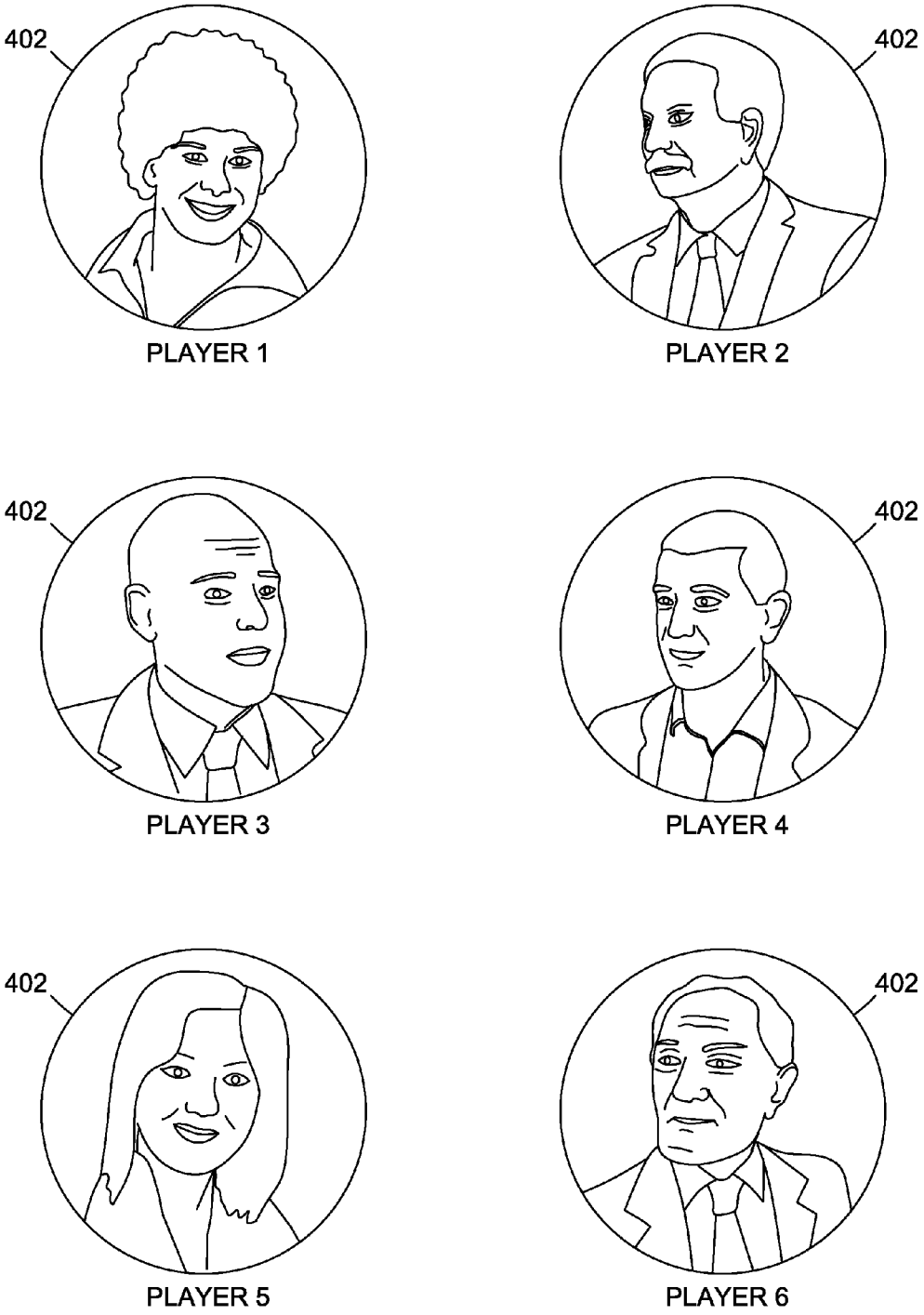
FIG. 4 shows an example of various artificially intelligent player profiles, according to one exemplary embodiment.

In step 304, the bettor picks which of the artificially intelligent players or profiles he or she thinks will win the game. For example, as shown in FIG. 4, there may be a variety of artificially intelligent characters 402 to choose from which may be graphically represented on the gaming machine display. The bettor's selected player may be placed in a game against one or more of the other characters. The other characters may be selected randomly or may also be selected by the player. In another embodiment, the bettor may choose two or more of the artificially intelligent players to participate in the game via the input device from the gaming machine. From among the bettor's chosen players, the bettor may then select which of the chosen players on which to place his or her bet. The characters 402 may be based off of well-known fictional or real characters, or the characters 402 may be created for a particular game.

The characters 402 may be configured to have different levels of artificial intelligence. As used herein, artificial intelligence refers to the ability of machines to work and react like humans. In other words, each of the characters 402 based on artificial intelligence may perceive game situations presented to them and react based on the knowledge the artificially intelligent character 402 has of the rules and strategy of the game being played. In one embodiment, as the artificially intelligent characters 402 play a game, they may learn game strategies based on the results of the game play. Thus, the artificially intelligent characters 402 may "learn" how to better play the game over time. In some embodiments, the amount of knowledge an artificially intelligent character 402 has learned during gaming may be reset after a gaming session by a particular bettor. In other embodiments, the knowledge acquired during one session of gaming may be applied to future games initiated by the same or a second bettor.

Figure 5:
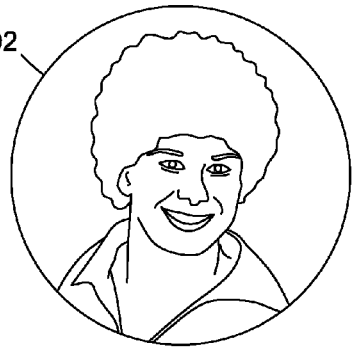
FIG. 5 shows an example matchup and pay tables for a game played between two artificially intelligent player profiles, according to one exemplary embodiment.
Figure 5:
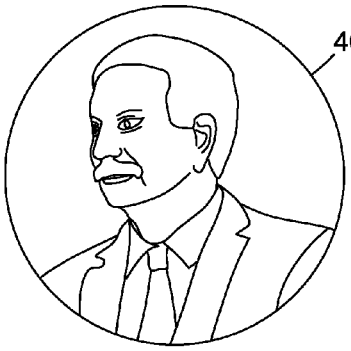

In another embodiment, a player may select an artificially intelligent character 402 based on a matchup of characters or profiles as shown in FIG. 5. In this example, two artificially intelligent characters 402 are matched against one another. Based on the knowledge programmed into or acquired by each character 402, or on the level of intelligence of each player, pay tables for selecting one of the players are presented. For example, a first pay table 504*a* may be presented for wagering on a first character 402, and a second pay table 504*b* may be presented for wagering on the second character 402. The awards on a pay table 504 may be higher for a player 402 with less knowledge and intelligence as compared to a player 402 with higher knowledge or intelligence. Other variations are also possible. For example, a matchup between more than two players may be presented with different pay tables for wagering on each player.

The bettor may also be provided with additional information to aid in the selection of the player/character 402. For example, a history of game results for each player 402 may be presented along with the player. In another example, a skill level of each player may be shown. In some embodiments, a wager required by the bettor may vary based on the character 402 selected. For example, a higher wager may be required to select a player with a high skill level. In still further embodiments, the wager may be dependent not only the selected player winning the game, but the selected player winning with a predetermined hand rank or higher, such as a full house or greater. In other variations, a payout may increase depending on the rank of the hand, such as increasing from a high card to a royal flush.

In step 306, the bettor may also make any bonus bets on the game outcome. For example, the bettor may make a wager based on a pay table that a winning hand will have a predetermined rank. The bettor may also make a wager that a losing hand will have a predetermined rank. Other side bets may include that the winning pot will be greater than or less than a predetermined amount. Any other combination of mandatory or optional bets may be made as is now known or later developed. Further, the bettor may be allowed to make the initial game wagers and optional side bets in any order or at any time prior to or during the game as desired by a game operator. The amount that the bettor may wager and the number of side bets in which the bettor may participant in may be set by a game operator as desired.

Next, in step 308, the artificially intelligent players play the game based on the game rules. Importantly, the artificial intelligent players are presented with a randomly generated game scenario and make game decisions through artificial intelligence processes. In other words, the RNG in the gaming machine is only used to randomize the game scenario, such as to shuffle game cards or the like. The game play by the characters is made in reaction to the generated scenarios through artificial intelligence.

Figure 6:
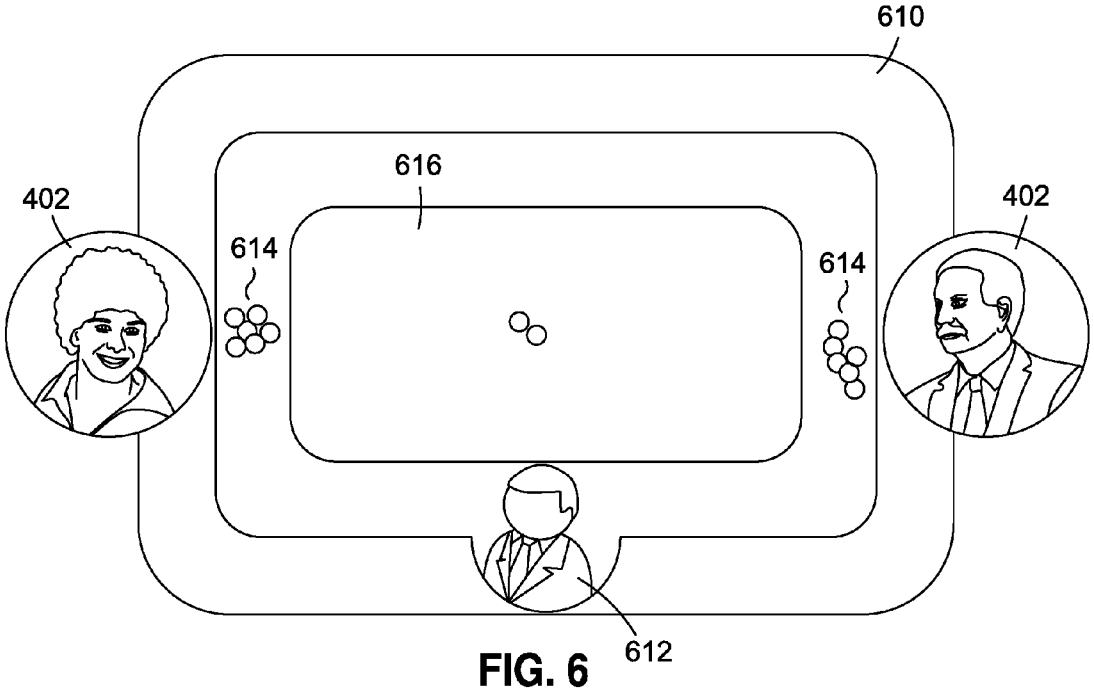
FIG. 6 shows game play on a display of a gaming device, according to one exemplary embodiment.

For example in FIG. 6, two artificially intelligent characters 402 are shown on a display of a gaming machine playing a game against each other. In this example, the players 402 are playing Poker, but any other type of suitable game may be played. The players 402 are shown playing at a gaming table 610. A dealer 612 may optionally be displayed. The players 402 may make ante wagers as may be required according to game rules at the player stations 614 at the gaming table 610. The gaming table 610 may also comprise a playing area 616.

Figure 7:
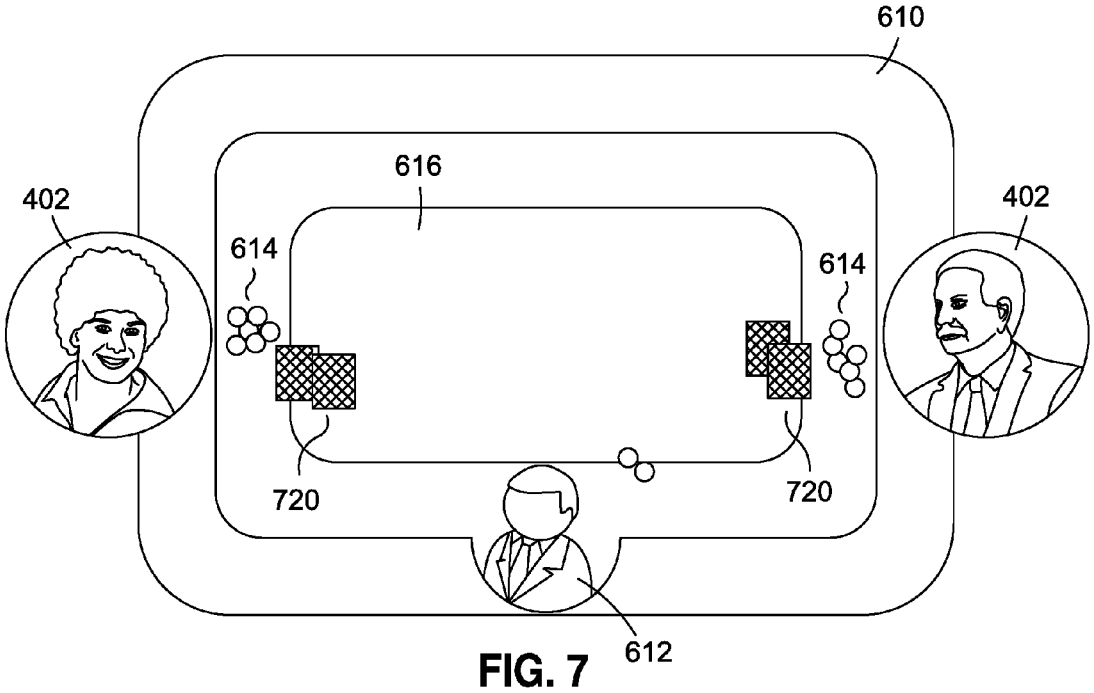
FIG. 7 shows game play on a display of a gaming device, according to one exemplary embodiment.

In FIG. 7, the dealer 612 deals two cards 720 to each player to form initial player hands. In this example, the cards 720 are shown face down. However, each artificially intelligent player 402 may "examine" the cards dealt 720 to the character 402 to evaluate the strength of the cards 720. In some embodiments, the cards 720 may also be visible to the bettor so that the bettor can also evaluate the hands to be apprised of what is happening in the game. In other embodiments, the bettor may only see the cards 720 of the selected player 402. In response to the player hand, the artificially intelligent players 402 may bet, raise, call, or fold according to game rules.

Figure 8:
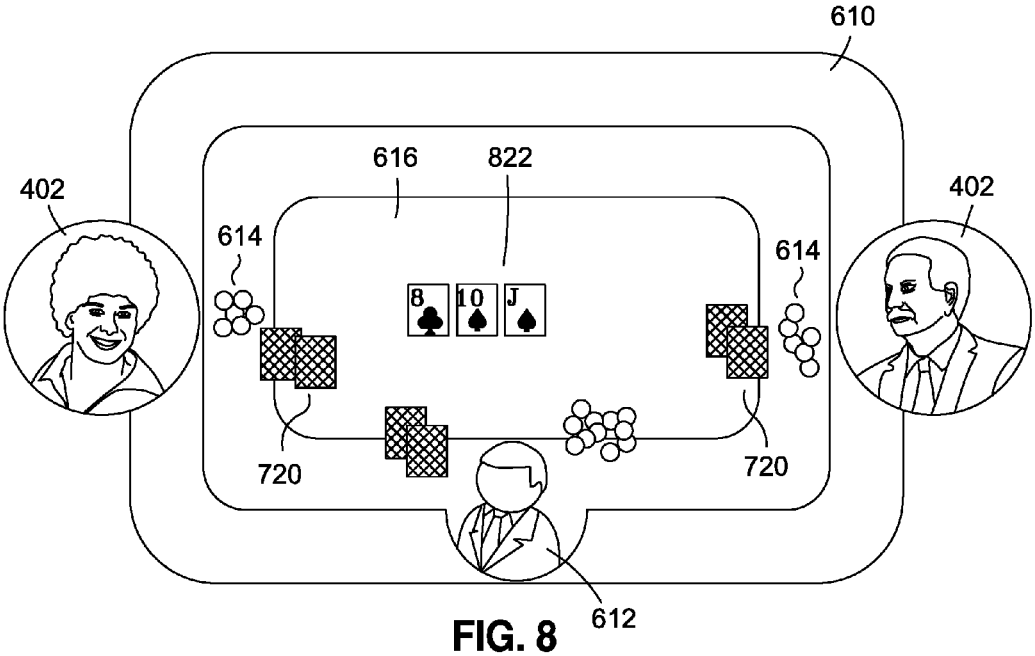
FIG. 8 shows game play on a display of a gaming device, according to one exemplary embodiment.
Figure 9:
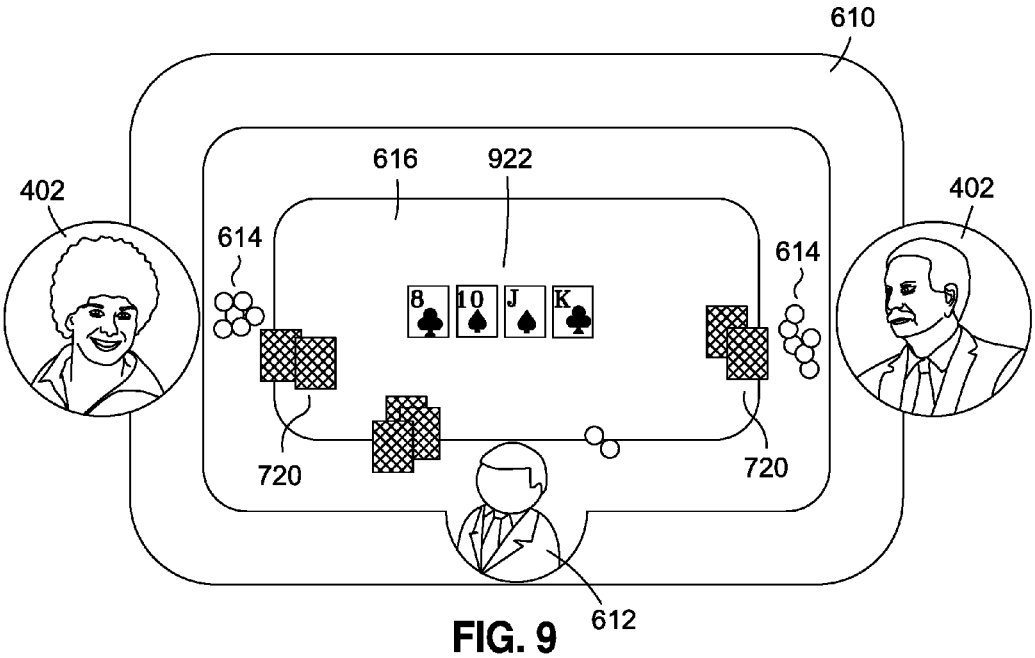
FIG. 9 shows game play on a display of a gaming device, according to one exemplary embodiment.
Figure 10:
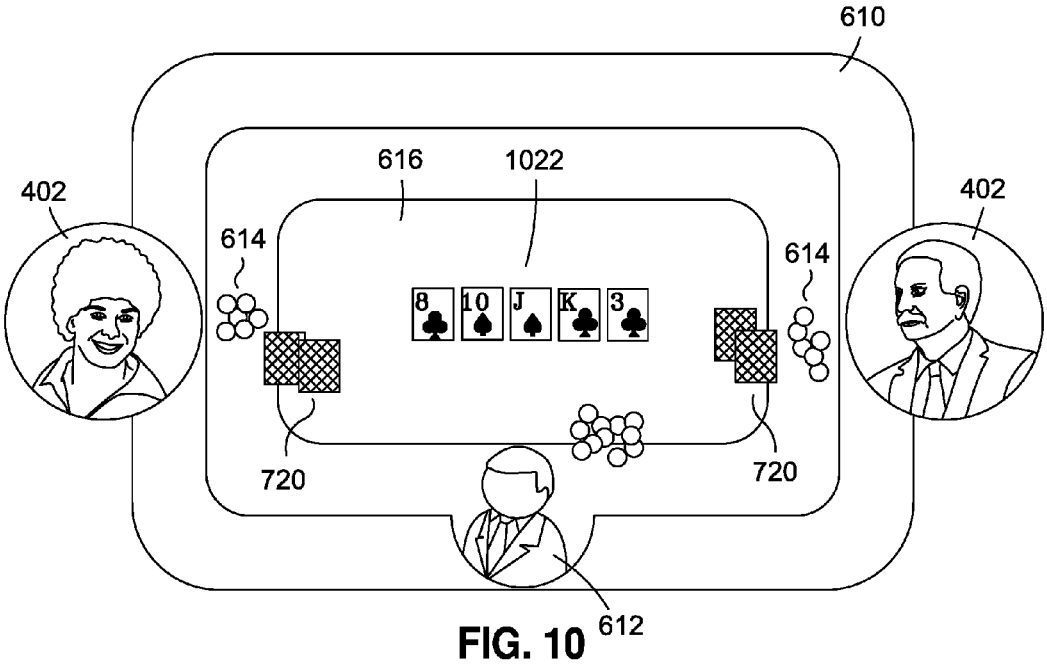
FIG. 10 shows game play on a display of a gaming device, according to one exemplary embodiment.

The dealer 612 next deals three community cards 822 as shown in FIG. 8. In this example, the community cards dealt are 8♣, 10♠, and J♠. Another round of betting may again be conducted by the artificially intelligent characters 402. Here, the artificially intelligent characters 402 base the decisions on the community cards 822 and their cards 720. Continuing in FIG. 9, the dealer 612 deals another community card for a total of four community cards 922. In this example, the fourth community card is a K♣. This is followed by another round of betting. Finally, as shown in FIG. 10, the dealer 612 deal another community card for a total of five community cards 1022. Here, the fifth community card is a 3♣. A final round of betting is conducted by the players 402.

Figure 11:
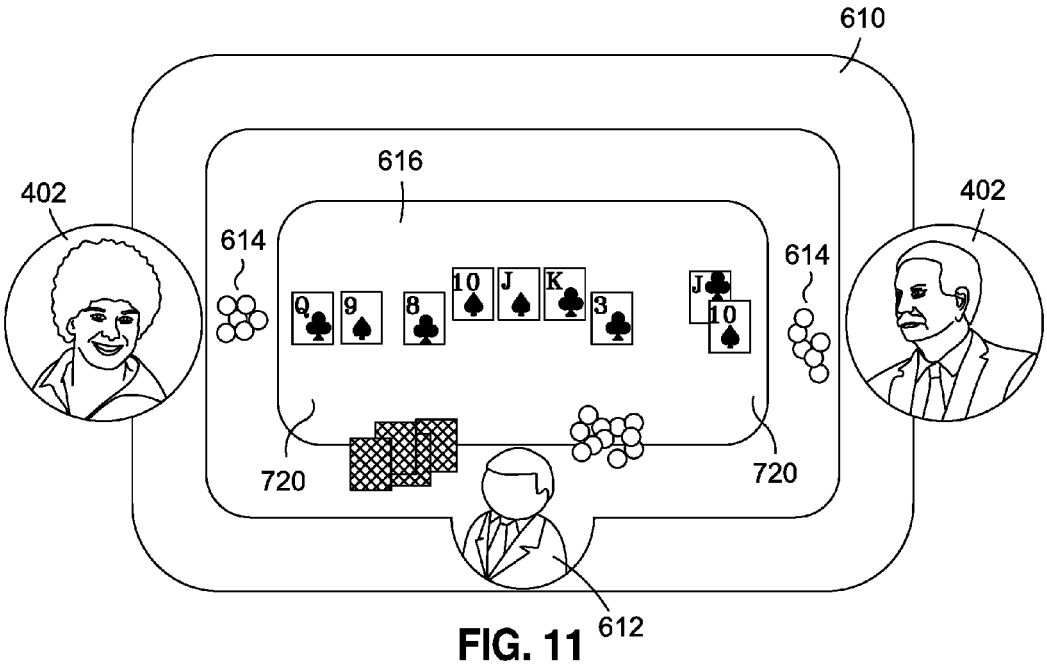
FIG. 11 shows game play on a display of a gaming device, according to one exemplary embodiment.

In FIG. 11, after all the community cards 1022 are revealed, the players reveal their cards 720, and winner is determined. In this example, one of the AI players 402 (the player on the left in FIG. 11) wins with a straight formed from his cards 720 and the community cards 1022. Returning to FIG. 3, in step 310, the game outcome for the bettor is determine by whether the bettor's selected character 402 wins the game, and the wager is collected or paid based on the game outcome.

Other variations are also possible. For example, the bettor may initiate a game and make a wager on a selected character after revealing at least a first card in each character's hand. The bettor may also be allowed to make multiple wagers on different players simultaneously during a game.

The use of artificially intelligent players in a casino gaming environment may allow casino operators new avenues of monetizing different types of games where odds may not be directly calculated. Casino games offered the public are based on odds that can be calculated. The basics of commercial casino games are that the games must pay the player something less than true odds. For example, a roulette wheel has 38 pockets in which the ball could drop (numbers 1 thru 36 plus 0 and a 00). A player betting a single number has a 1 in 38 chance of picking the winning number and a 37 in 38 chance of choosing a non-winning number. Therefore, the true odds are 37 to 1. In order to make the game profitable, the casino might pay 35 to 1. That is, something less than true odds. Casino game odds are set to be calculated in this manner. However, the disclosed embodiments based on artificially intelligent players may allow monetization of games where calculating the true odds is impossible. In the embodiments, such as the poker game example disclosed above, a game is created where Artificially Intelligent virtual players compete against one another in a game of skill. The odds used may be derived from simulating millions and millions of games between artificially intelligent players at various skill levels to create the games' probable odds.

As another example, certain games of skill, such as games similar to "Scrabble" or "Words with Friends" may be played by artificially intelligent players. Scrabble is a word game in which two to four players score points by placing tiles, each bearing a single letter, onto a game board which is divided into a 15×15 grid of squares. The tiles must form words which, in crossword fashion, flow left to right in rows or downwards in columns. The words must be defined in a standard dictionary. Specified reference works (e.g., the Official Tournament and Club Word List, the Official Scrabble Players Dictionary) provide a list of officially permissible words. The game is sold in 121 countries and is available in 29 languages; approximately 150 million sets have been sold worldwide and roughly one-third of American homes have a Scrabble set.

A more recent and similar version of Scrabble is called Words with Friends. This is an extremely popular game that can be played on a computer via a website or social networking site or on a mobile device app such as via an iPad or iPhone where one player can play against another.

Games such as these have in the past not lent themselves to be used in a commercial gambling operation. However, when such a game is applied as described herein using artificially intelligent players, it may be commercialized in a number of different ways.

An example of this is described with reference to FIGS. 12-13C. The game may be played with a predetermined number of tiles each having a letter and associated point value. In this example, 104 tiles are used, however any number of tiles and tile point values may be implemented. Additionally, some tiles may be wild tiles which have an associated point value. An example of tiles and point values is given in Table 1. An example of the tile distribution is given in Table 2.

TABLE 1

| Points | Tile Type |
|---|---|
| 0 Points | Wild Tile |
| 1 Point | A, E, I, O, R, S, T |
| 2 Points | D, L, N, U |
| 3 Points | G, H, Y |
| 4 Points | B, C, F, M, P, W |
| 5 Points | K, V |
| 8 Points | X |
| 10 Points | J, Q, Z |

TABLE 2

| Tile Description | Number of Tiles |
|---|---|
| Wild Tile | 2 |
| A | 9 |
| B | 2 |
| C | 2 |
| D | 5 |
| E | 13 |
| F | 2 |
| G | 3 |
| H | 4 |
| I | 8 |
| J | 1 |
| K | 1 |
| L | 4 |
| M | 2 |
| N | 5 |
| O | 8 |
| P | 2 |
| Q | 1 |
| R | 6 |
| S | 5 |
| T | 7 |

TABLE 2-continued

| Tile Description | Number of Tiles |
|---|---|
| U | 4 |
| V | 2 |
| W | 2 |
| X | 1 |
| Y | 2 |
| Z | 1 |

The game begins with a bettor making a wager on one of the artificially intelligent players available. The gaming device may randomly select artificially intelligent players that are participating in the game, or the player may have the option of the selecting the participating players. For example, the bettor may choose two or more opponents of similar skill such as a master player versus another master player, or two or more opponents of varying skill like a master player versus an average player. Notably, while different artificially intelligent players have different skill levels, the less skilled can still defeat the more skilled based on the random allotment of the tiles. Typically, however, the less skilled player will beat the higher skilled player less often than losing to the higher skilled player. Each matchup of two or more players may have a different pay table based on the skill level of the opponents matched. Based on the matchup chosen, the bettor selects one of the artificially intelligent players to win the game. Other bets may also be made such as bets on the margin of victory, a minimum winning score, a minimum combined score of the players, highest single word score, length of the longest word played, or the like. One or more bets may be made on one or both players during a single game.

Figure 12:
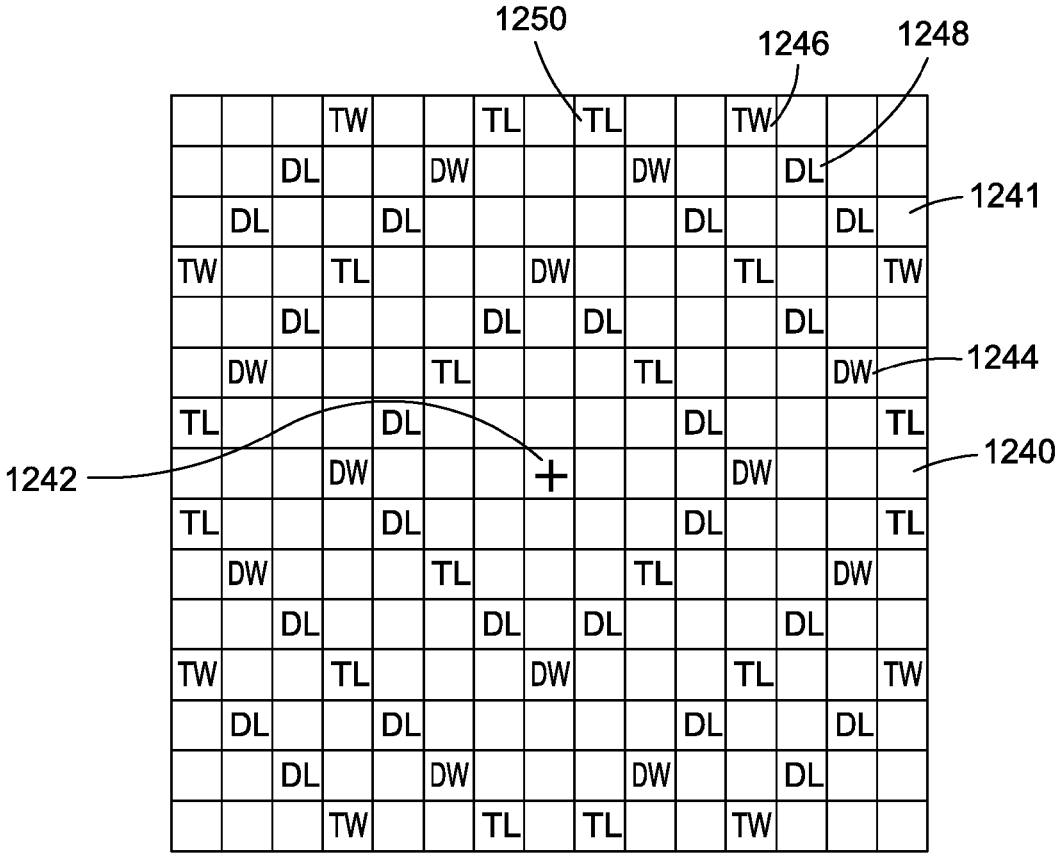
FIG. 12 shows game play on a display of a gaming device, according to one exemplary embodiment.

The objective for the artificially intelligent players is to form words horizontally or vertically on the board, such as board 1240 shown in FIG. 12. Board 1240 has a plurality of spaces 1241 on which the players place tiles. A center "+" tile defines a space on which the first player must place his or her first word. The board 1240 may also include "DW" spaces 1244 designating that words made by tiles including that space 1244 are awarded double points, "TW" spaces 1246 designating that words made by tiles including that space 1246 are awarded triple points, "DL" spaces 1248 designating double points for tiles placed on those spaces 1248, and "TL spaces 1250 designating triple points for tiles placed on those spaces 1250. The board 1240 is merely exemplary, and other variations of boards may also be used.

The game is played between the two artificially intelligent players. Players take turns drawing tiles and forming words horizontally or vertically on the board 1240, trying to score as many points as possible for each word. The following is one possible example of rules governing the placement of the tiles and the words formed. Before each turn, a player draws tiles for a total of seven tiles on the player's rack. That may be accomplished by the RNG of the gaming device randomly assigning tiles to the player's rack until there is a total of seven tiles on the player's rack. The first word played is placed so that the one of the tiles is on the "+" space 1242 in the center of the board 1240. Every word following that must be placed so that at least 1 tile is shared from an existing word on the board. Tiles may only be placed in the same line vertically or horizontally on each turn. Tiles may be placed so that multiple new words are formed simultaneously using neighboring letters. Words cannot be placed if they create an illegal word using neighboring letters. All words labeled as part of speech (including those listed of foreign origin, and as archaic, obsolete, colloquial, etc.) are permitted with the exception of the following: proper nouns (words always capitalized), abbreviations, prefixes and suffixes standing alone, or words requiring a hyphen or apostrophe.

For example as shown in FIGS. 13A-13C, the players may take turns forming words on the board 1240. In FIG. 13A, the first player formed the first word "HORN," and the second player added a vertical word "FARM" building off of the first word. In FIG. 13B, the first player adds a horizontal word "PASTE" which also forms a new word "FARMS" from the previously played word. In FIG. 13C, the second player plays the word "MOB" while also forming two other new words "NOT" and "BE."

The scoring is based on the words formed by the players based on the values of the tiles used including any multipliers based on their placement on the board. Bonus points may be given where all the tiles on a rack are used by the player in a single turn. Further, when multiple new words are created, the score for all of the new words may be added to the player's total. The game ends when one player plays every tile in the player's rack, and there are no tiles remaining to draw from. The game may also end if three successive turns have occurred with no scoring and as long as the score is not zero-zero. When the game ends, players with tiles left over may lose points equal to the sum of the value of the remaining tiles. The amount may be awarded to the player who placed the last tile. The wagers made by the player are then resolved according to the outcome of the game between the artificially intelligent players.

Other variations of such a game are also considered. For example, the bettor may make any number of different wagers based on the matchups of two or more artificially intelligent players. Such wagers may include:

1. The player that will have the highest total word score, thus winning the game.
2. The player that will have the highest single word total during the game.
3. The length of the longest word played in the game having a certain number of letters.
4. The number of letters played in the longest word being over/under specific number (for example, over 12 letters/under 10 letters).
5. The player that will play the longest word in the game.
6. The highest word score in the game being over or under a specified score.
7. The margin of victory between the two players.
8. The total points scored by a chosen player. This may be based on a pay table with the payout increasing as the total points scored increases, or the wager could be on an over or under a specific total score.
9. Both players tying. This occurs very infrequently and would have a significantly large payout.
10. The number of lead changes in the game.

It will be appreciated that other modifications are also possible such as playing different games with the artificially intelligent players such as backgammon, chess, or other board or card games where odds may or may not be directly calculable. Further, different grid sizes may be used, or a total number of tiles may be changed to increase or decrease the length of the game. The tile point values may be modified, and the layout and number of bonus spaces may be changed. The presentation may also be managed so as to increase excitement of the game. For example, the game speed may slow down towards the end of the game near the crucial betting moment, such as when a score is nearing an over/under total point wager.

As shown in the above examples, it is possible to commercialize a variety of different games where the odds are not able to be calculated in the traditional manner. Instead, the odds may be ascertained by multiple simulations of the game between various artificially intelligent players. Furthermore, many new types of wagers and games may be played based on the above-described concept as shown in the examples above.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine comprising:
- a controller including at least one random number generator and an artificial intelligence module;
- at least one electronic display;
- a wager accepting device configured to accept a physical item associated with a monetary value;
- at least one player input device; and
- a memory storing machine-readable code executable by the controller to cause the gaming machine to
  - receive a wager from a bettor at the gaming machine via the at least one player input device from funds accepted via the wager accepting device;
  - display via the at least one electronic display a plurality of artificially intelligent players as potential players of a game at the gaming machine;
  - receive a first designation of a matchup from the bettor via the at least one input device selecting at least two of the artificially intelligent players for playing the game at the gaming machine;
  - receive a second designation from the bettor designating a selected player from the at least two players of the designated matchup;
  - present the game at the gaming machine via the at least one electronic display, the random number generator randomizing game pieces for playing the game, and the artificial intelligence module determining game play decisions based on the artificially intelligent players of the designated matchup;
  - determine a game outcome including a winner from the at least two players of the designated matchup; and
  - collect or pay out the wager made by the bettor based on whether the selected player is a winner according to the game outcome.

2. The gaming machine of claim 1, wherein the artificially intelligent players are configured to have different skill levels.

3. The gaming machine of claim 1, wherein wagers are paid according to a pay table, and odds designated in the pay table are calculated based on simulations of games played by the artificially intelligent players.

4. The gaming machine of claim 1, wherein the game is poker and the game pieces are at least one deck of playing cards.

5. The gaming machine of claim 4, wherein the bettor places a bonus bet on the winning hand having a predetermined rank or higher.

6. The gaming machine of claim 4, wherein the bettor designates the selected player after at least one card in each player hand is dealt and revealed.

7. The gaming machine of claim 1, wherein the game is a scrabble game and the game pieces are letter tiles.

8. The gaming machine of claim 7, wherein the bettor places a bonus bet on which of the at least two players will have the highest single word total and/or on a margin of victory of a winning player.

9. The gaming machine of claim 7, wherein the bettor places a bonus bet on a number of letters of a longest word played during the game.

10. A gaming system comprising:

at least one game server comprising a processor configured to execute machine readable code, at least one random number generator and an artificial intelligence module;

at least one communication interface which permits said game server to transmit information to a plurality of presentation computing devices and to receive information from a plurality of presentation computing devices;

at least one data storage device configured to store social media information regarding a plurality of users, each user identifiable by a user account; and machine readable code executable by said processor configured to cause said game server to receive a wager from a bettor at the presentation device, the presentation device comprising a wager accepting device configured to accept a physical item associated with a monetary value to fund the wager;

display via at least one electronic display on the presentation device a plurality of artificially intelligent players as potential players of a game at the gaming machine;

receive a first designation of a matchup from the bettor via the presentation device selecting at least two of the artificially intelligent players for playing the game via the game server;

receive a second designation from the bettor designating a selected player from the at least two players of the designated matchup;

present the game at the presentation device, the random number generator randomizing game pieces for playing the game, and the artificial intelligence module determining game play decisions based on the artificially intelligent players of the designated matchup;

determine a game outcome including a winner from the at least two players of the designated matchup; and collect or pay out the wager made by the bettor based on whether the selected player is a winner according to the game outcome.

11. The gaming system of claim 10, wherein the artificially intelligent players are configured to have different skill levels.

12. The gaming system of claim 10, wherein wagers are paid according to a pay table, and odds designated in the pay table are calculated based on simulations of games played by the artificially intelligent players.

13. The gaming machine of system 10, wherein the game is poker and the game pieces are at least one deck of playing cards.

14. The gaming system of claim 13, wherein the bettor places a bonus bet on the winning hand having a predetermined rank or higher.

15. The gaming system of claim 13, wherein the bettor designates the selected players after at least one card in each player hand is dealt and revealed.

16. The gaming system of claim 10 wherein the game is a scrabble game and the game pieces are letter tiles.

17. The gaming system of claim 16, wherein the bettor places a bonus bet on which of the at least two players will have the highest single word total.

18. The gaming system of claim 16, wherein the bettor places a bonus bet on a number of letters of a longest word played during the game.

* * * * *